United States Patent [19]

Williams

[11] Patent Number: 4,484,685

[45] Date of Patent: Nov. 27, 1984

[54] MAIL SORTING RACK

[76] Inventor: James Williams, 6209 Amber Lake Ave., San Diego, Calif. 92119

[21] Appl. No.: 349,115

[22] Filed: Feb. 16, 1982

[51] Int. Cl.[3] ..... B07C 7/02

[52] U.S. Cl. ..... 209/703; 206/561; 209/900; 211/10

[58] Field of Search ..... 209/703, 702, 900, 942, 209/933; 211/10, 11, 50, 184; 312/198, 183, 187; 206/425, 555, 556, 561, 557, 559

[56] References Cited

U.S. PATENT DOCUMENTS

| | | | |
|---|---|---|---|
| 1,030,317 | 6/1912 | Middaugh | 211/10 |
| 1,199,524 | 9/1916 | Bourn | 211/10 |
| 1,255,940 | 2/1918 | Smith | 211/10 |
| 1,258,004 | 3/1918 | Heath | 312/198 |
| 1,593,326 | 7/1926 | Bourn | 312/198 |
| 1,619,420 | 3/1927 | Hoth | 211/11 |
| 2,742,161 | 4/1956 | Nuttall | 211/11 |
| 3,554,429 | 1/1971 | Cohen | 206/561 |

*Primary Examiner*—Randolph Reese
*Assistant Examiner*—Donald Hajec
*Attorney, Agent, or Firm*—Charmasson & Holz

[57] ABSTRACT

A mail sorting rack is provided utilizing a rack structure with a plurality of parallel divider blades between which the postal worker inserts mail pieces for various addresses in order, there being a tray in the instant invention underlying the mail which enables the worker to pull the tray free of the extending blades, eliminating the dividers from the sorted mail so that he may more easily group and band them for delivery.

8 Claims, 10 Drawing Figures

MAIL SORTING RACK

BACKGROUND OF THE INVENTION

The invention is in the field of mail sorting and particularly pertains to that aspect of sorting handled by the mail carrier before leaving on his route. Currently, the routeman has a rack with about four levels, each rack being perhaps four feet wide. There are a number of dividers slightly more than an inch apart in each rack, and at the bottom of the forward edge of the racks is a label identifying the space between each rack with a house number on a street. Thus, half a rack might represent one side of one street in the postman's route.

When the delivery man receives his unsorted mail, he proceeds to sort it between the divider blades in his racks so that each pair of blades contains therebetween the mail intended for one house or business. After the mail is all sorted, the mailman takes down the mail by pulling out each batch separately from between the respective dividers, and then grouping them together, undivided, in large groups of perhaps two dozen or more delivery stop. Thus, although the divider blades are necessary to permit the mailman to sort the mail initially, they become a liability when he takes down the mail for grouping and banding because he must individually pull out the mail pieces from between each set of blades.

In addition to the time lost in individually pulling down these small groups of mail, there is also a tendency for "sleepers", small pieces of mail that do not come down with the group, to be left up in the rack. These sleepers may stay there for several days before they are discovered. Thus, there is a definite need for some type of apparatus which would easily separate whole groups of mail from the dividers without having to separate it all individually.

At least three different devices have been invented directed towards solution of this problem. The first invention, having U.S. Pat. No. 1,030,317, utilizes removable dividers which are simply pulled free of the mail rack. However, in this day and age, there are ordinarily many blade pairs which have mail literally jammed between them, so that in a situation utilizing removable blades of the type shown in this patent, often times the mail would come free with the dividers.

Another separating device is disclosed in U.S. Pat. No. 1,217,973 issued in 1917. This suffers from the same drawback mentioned above, that is in modern times there is ordinarily too much mail to enable such a kilm system to work. Also, different size pieces would flip upwardly due to the wire construction of the flip-up bars in this last mentioned device.

The third device, the subject of U.S. Pat. No. 1,593,326, most closely approaches applicant's invention by utilizing a number of blades which remain within the rack of the sorting device and have trays which pull out forwardly with the mail therein. However, this device also appears to be impractical in today's world because first, the divider blades of that invention pivot upwardly, and to pull a two-foot or four-foot tray full of mail out against the resistence of dozens of pivoted dividers would be obviously inconvenient. Also, a lot of today's letters contain bulky objects such as pencils, and the upward pivot motion of the separators would snag on the bulky protrusion and jamb the letters against the bottom of the above shelf. Further, the back bar of that invention probably would not serve to stop all pieces of mail, as it only catches the mail at the bottom and not near the top where it must be to be effective, so that some would be left inside the rack after the sorting tray had been pulled forward.

There is thus a need for a simple, inexpensive, lightweight apparatus to facilitate mail sorting as thus described.

SUMMARY OF THE INVENTION

The present invention provides such an apparatus. The sorting rack structure utilized in the invention is similar to the four-tiered rack now used in the post office, but rather than having fixed dividers and no means of getting the mail out of the dividers other than by hand, dividers are used which are cantilevered so that they are spaced from the floor of the rack, permitting the insertion of a tray which has a bottom panel which passes beneath all of the divider blades.

The back of the tray has a collecting means, either a comb with flat tines passing up between all the dividers, or a drawbar spanning the top of the tray and engaging the upper portion of each envelope in the sorting rack. Either embodiment permits the tray to be easily and conveniently drawn forward, bringing all the mail with it, so that it can be placed on a work table with the ordered mail banded and bagged for delivery.

DETAILED DESCRIPTION OF THE PREFERRED EMBODIMENT

Figure 1:
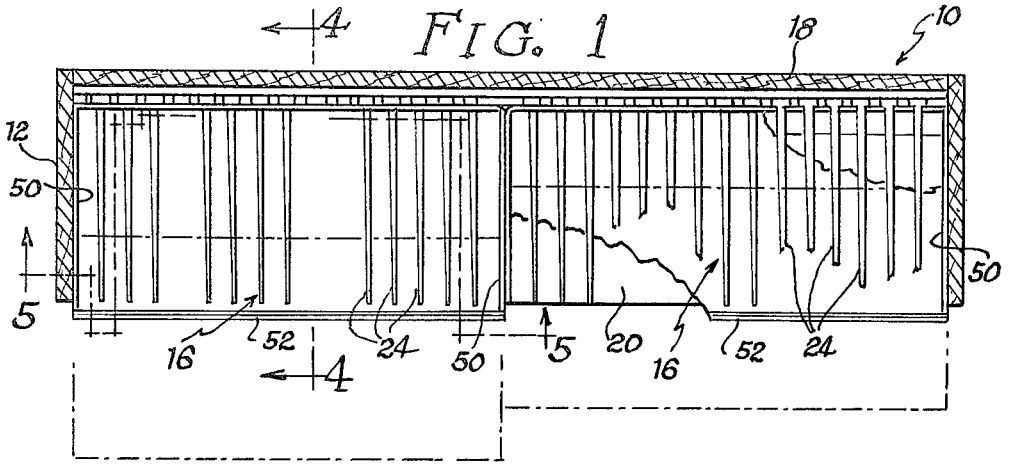
FIG. 1 is a plan view of a rack containing two removable trays.
Figure 2:
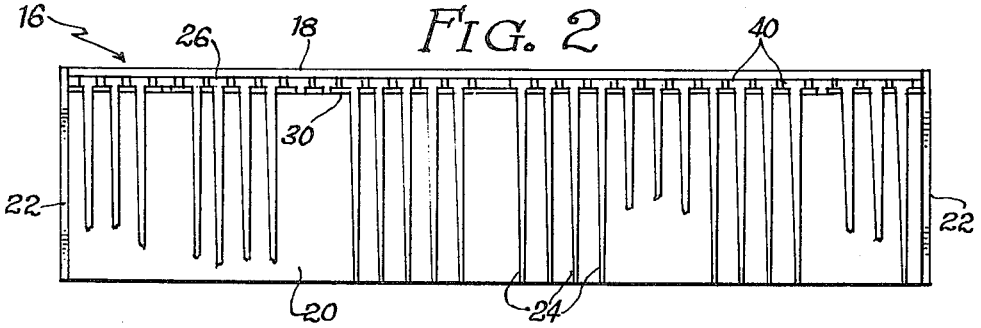
FIG. 2 is a plan view of the rack in FIG. 1 removed from its cabinet and having the trays removed.
Figure 3:
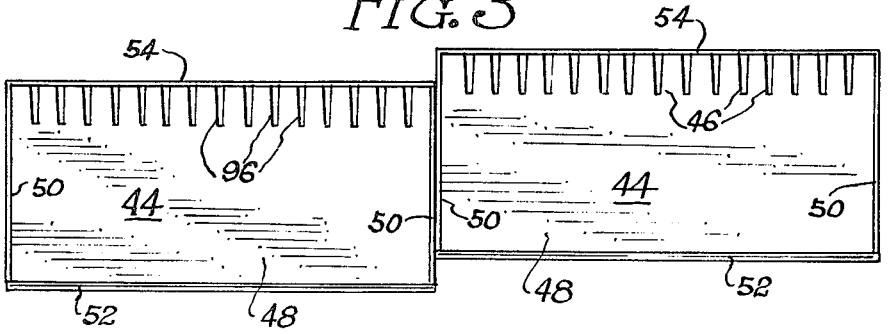
FIG. 3 is a plan view of the two trays illustrating one embodiment of tray construction.
Figure 4:
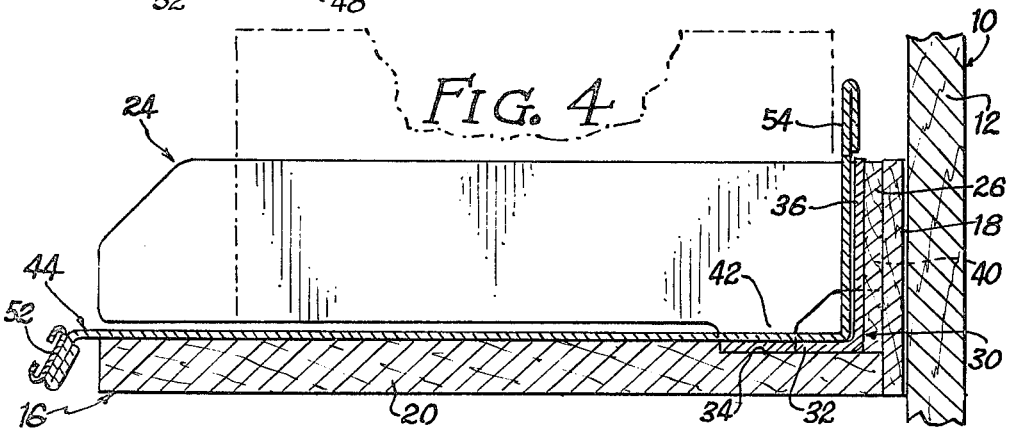
FIG. 4 is a section taken along line 4—4 of FIG. 1.
Figure 5:
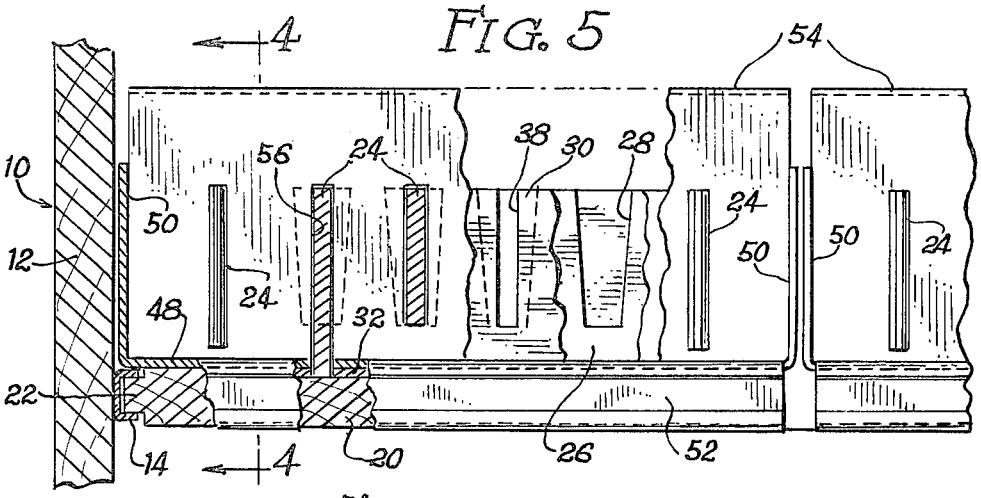
FIG. 5 is a section taken along line 5—5 of FIG. 1.

The invention would ordinarily be utilized in a large cabinet 10 which is rectangular and open, having side walls, bottom and top walls, and a rear wall. This cabinet houses four racks in ordinary usage. The entire cabinet is not shown in the drawings. At four spaced intervals along the cabinet walls 12 are a pair of opposed tracks 14 which although used presently to hold currently used racks, can just as well be used to support the racks of the instant invention.

Figure 7:
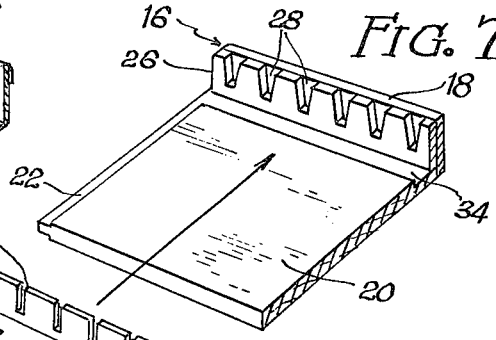
FIG. 7 is a perspective of the left end of one embodiment of the racks.
Figure 8:
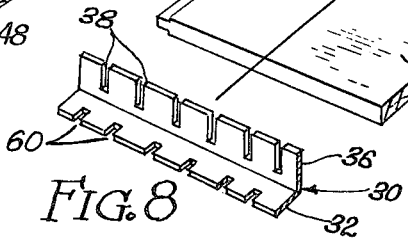
FIG. 8 is a perspective of a notched insert and retainer which fits into the rack.
Figure 9:
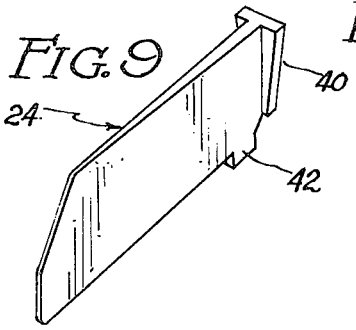
FIG. 9 is a perspective view a divider blade.

The racks 16 of the instant invention, as best seen from FIG. 7, basically constitutes a back panel 18 with a floor 20. The lateral or side edges of the floor are reduced as shown at 22 so that they fit in the tracks 14 in the sides of the cabinet 10. This also provides a plainer upper surface adjacent the tracks 14. The rack must have some means for supporting a multiplicity of spaced projecting divider blades 24 so that all or most of the bottom edge of the blade clears the floor 20 with sufficient clearance to permit the passage of the tray therebeneath. In the preferred embodiment, this is accomplished by constructing the back panel 18 in sandwich fashion, with a rear formed face and a middle laminate 26 being provided with spaced notches 28 having V-shaped expanded portions interiorly of said face. An L-shaped insert 30 slips back against the middle laminate 26, the lower panel 32 of the insert slipping into a channel 34 cut into the floor of the rack.

The upper leg or panel 36 of the insert has a plurality of parallel-edged notches 38, so that when this panel defines the forward laminate of the rear panel 18, the effect is to form a slot which is parallel when entered from the front and expands rearwardly to define a widened V-shaped cavity.

Each of the divider blades 24 in the preferred embodiment has a V-shaped T-panel 40 defined at the rear thereof. This panel slips into the notches 28, defining a secure, strong connection between the blade and the back panel. For further strength, a foot 42 may be incorporated in the blade just forward of the T-panel. This foot seats down into the channel 34 and is captured in one of the notches 60 of the insert 30. This construction is particularly strong and not particularly expensive or difficult to achieve. Being removable, the blades make possible the creation of double, triple, and even larger spaces to accommodate particular addresses that habitually receive more than the usual amount of mail.

If this type of blade construction is used, the tray 44 must have re-entrant spaced notches 46 in the rear edge of its bottom panel 48 to accommodate the feet 42 of the blades.

Beyond these cutaways, the tray incorporates a pair of lateral sides 50 and a strip or panel 52 to permit labeling the spaces between the blades according to the house or business it represents. The strip 52 is ideally integral with the tray bottom and strong enough to permit usage of the strip as a handle.

Figure 6:
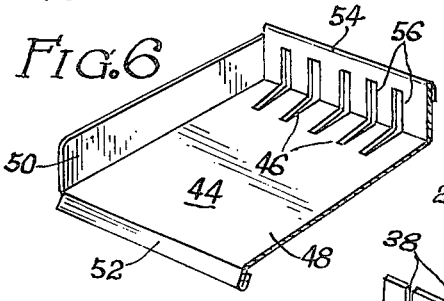
FIG. 6 is a perspective of the left end of one embodiment of the tray.
Figure 10:
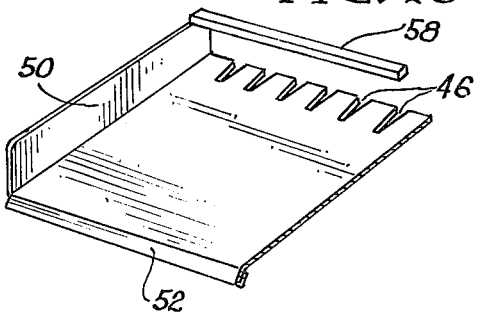
FIG. 10 is a perspective view of a second embodiment of the tray.

In all events, the bottom panel 48 is sufficiently thin to pass beneath the cantilevered blades 24, atop the floor 20 of the rack. The rear of the tray could be made in a variety of ways, but the two embodiments shown are, first, a solid back wall 54 could be used, as illustrated in FIG. 6, with pass-through slots 56 to accommodate the blades. This construction is strong and very effective, but to even further streamline the tray, the configuration in FIG. 10 could be used wherein a drawbar 58 replaces the comb structure of the back wall 54, the drawbar being low enough to purchase a sufficient portion of the upper rear edge of a mailing piece so that no "sleepers" will lie behind in the rack. Inasmuch as the minimum mail dimension is $3\frac{1}{2}$ inches, a drawbar height of about 3 inches would effectively prevent sleepers.

A third embodiment, not shown, could be simply a comb structure similar to the configuration of the metal laminate 26 of the back panel. The flat, wide tines of the comb would effectively draw the mail between the blades. In fact, the embodiment of FIG. 6 actually represents a comb structure with a drawbar integral with the top of the tines.

It can be seen that all of the blades are tapered in the forward direction. The effect of this taper is to permit the easier withdrawal of the trays from the racks. As the tray draws forwardly, the lateral space available for the mail might increase by more than an inch overall, on a two-foot wide tray, making it easier to draw the mail out. This tapering will further reduce the possibility of creating sleepers.

The cabinets presently used in post offices across the country are four feet wide. As shown in FIG. 1, the trays illustrated in the instant disclosure are two feet wide, making it easier on the mailman than it would be if he had to pull out a four-foot wide tray, which could be very awkward. It also simplifies replacement of the tray, especially in the event that the configuration of FIG. 6 is used in which the slots 56 would have to be aligned with all of the blades.

The invention has been in used in a post office and has significantly reduced the time required to sort mail. It has been received enthusiastically, and if adapted as standard post office equipment, could significantly reduce mail storing time and thus shave a few precent from the cost of mail delivery.

What is claimed is:

1. A sorting apparatus for assisting the sorting of a group of mail pieces or the like into a plurality of consecutive sub-groups divided by dividers and subsequent removing the dividers from said group, said apparatus comprising:

(a) a rack having a floor and defining a plurality of forwardly projecting parallel divider blades spaced above said floor;

(b) a tray having a bottom panel which slides over said floor and a rear side sufficiently open to permit said blades to pass therethrough when said tray is slid back onto said floor and over said blades in nesting relationship with said rack;

(c) baffle means spanning the rear side of said tray for blocking the passage of mail pieces passing therethrough, whereby said tray can be nested in said rock, mail pieces sorted between said blades, and said tray drawn clear of said rack with said mail pieces ordered and free of said divider blades; and (d) said baffle means comprising a drawbar spanning said tray and spaced above said bottom panel sufficiently to permit passage of said blades thereunder.

2. Structure according to claim 1 wherein said tray includes lateral side panels and said drawbar is mounted to the upper rear portion of said side panels.

3. Structure according to claim 1 wherein said baffle means further comprises a comb structure integral with said drawbar, said comb structure being upwardly directed from said bottom panel at the rear side of said tray, said comb having flat tines substantially spanning the space between said blades and interstitial spaces sufficiently wide to pass said blades therethrough, and including a drawbar spanning the tops of said tines sufficiently high above said bottom panel to permit passage of said blades through said spaces.

4. Structure according to claim 1 wherein said blades are removable from said rack, said rack has a back panel, said back panel has a formed face and defines a plurality of open-topped spaced slots that have an expanded portion interiorly of the formed face of said back panel, said removable blades each defines a perpendicular T-panel across the rear end thereof to slip into a respective one of said slots, the expanded portion of said slot is tapered laterally inwardly toward the bottom, and said T-panels are cooperatively tapered to produce greater strength of engagement between said blades and said rack.

5. Structure according to claim 4 wherein said back panel is of sandwich construction to conveniently define said slots, with a middle laminate defining said expanded portions and a forward laminate defining parallel-walled slots to engage the sides of said blades.

6. Structure according to claim 5 wherein each of said blades has a depending support foot resting on said floor forward of said back panel.

7. Structure according to claim 6 wherein said floor has a relieved channel just forward of said back panel and said forward laminate defines the upper leg of an L-shaped insert, the lower leg of which fits into said channel and defines slots to seat the feet of said blades.

8. Structure according to claim 6 wherein the bottom panel of said tray defines re-entrant spaced notches at the rear edge thereof to accommodate said feet.

* * * * *